United States Patent [19]

Birat et al.

[11] 4,299,267

[45] Nov. 10, 1981

[54] COOLING JACKET FOR AN INGOT MOLD FOR THE CONTINUOUS CASTING OF METAL AND AN INGOT MOLD PROVIDED WITH THE COOLING JACKET

[75] Inventors: Jean-Pierre Birat, Semecourt; Louis Vedda, Metz, both of France

[73] Assignee: Institut de Recherches de la Siderurgie Francaise, Saint-Germain-en-Laye, France

[21] Appl. No.: 29,914

[22] Filed: Apr. 16, 1979

[30] Foreign Application Priority Data

Apr. 17, 1978 [FR] France ..... 78 11285

[51] Int. Cl.[3] ..... B22D 27/02; B22D 11/10

[52] U.S. Cl. ..... 164/502; 164/418; 164/443

[58] Field of Search ..... 164/89, 147, 250, 418, 164/443, 348, 251

[56] References Cited

U.S. PATENT DOCUMENTS

| | | | |
|---|---|---|---|
| 2,867,018 | 1/1959 | Harter, Jr. et al. | 164/443 X |
| 4,009,749 | 3/1977 | Alberny | 164/147 |
| 4,040,467 | 8/1977 | Alberny et al. | 164/147 X |

FOREIGN PATENT DOCUMENTS

| | | | |
|---|---|---|---|
| 2196866 | 3/1974 | France . | |
| 2352430 | 12/1977 | France | 164/147 |
| 2248103 | 2/1978 | France . | |
| 2324395 | 3/1979 | France . | |
| 2324397 | 6/1979 | France . | |
| 1090858 | 11/1967 | United Kingdom | 164/418 |

*Primary Examiner*—Robert D. Baldwin

*Assistant Examiner*—Gus T. Hampilos

*Attorney, Agent, or Firm*—Michael J. Striker

[57] ABSTRACT

A cooling jacket for an ingot mold for the continuous casting of metal comprises a tubular element and a grid of stiffening ribs projecting from the outer surface of the tubular element, in which the grid is provided at the intersection of the stiffening ribs with openings or bores which pass also through the tubular element for the passage of fastening elements in form of tie rods therethrough by which an inner tube for the passage of the metal to be cast can be fastened to the cooling jacket with radial clearance. The upright ingot mold in which the cooling jacket is used and which is especially employed for the casting of steel, includes, besides the cooling jacket and the inner tube, an outer shell surrounding the cooling jacket with considerable clearance. The outer shell is closed by plates at opposite ends to which opposite ends of the inner tube are respectively fastened and these plates are provided with openings aligned with the opposite open ends of the inner tube. The space between the tubular element of the cooling jacket and the outer shell is divided by a transverse wall in a lower chamber with which the open lower end of the tubular element of the cooling jacket communicates and a longer upper chamber with which the open upper end of the tubular element communicates. A cooling water inlet communicates with the lower chamber adjacent the separating wall and a cooling water outlet communicates with the upper compartment at the other side and adjacent to the separating wall. A polyphase magnetic inductor is located in the upper compartment around the cooling jacket.

12 Claims, 4 Drawing Figures

COOLING JACKET FOR AN INGOT MOLD FOR THE CONTINUOUS CASTING OF METAL AND AN INGOT MOLD PROVIDED WITH THE COOLING JACKET

BACKGROUND OF THE INVENTION

The present invention generally relates to the continuous casting of metal, especially steel. More precisely, the present invention is concerned with a cooling jacket with which the ingot mold is provided, particularly such ingot molds which contain an electromagnetic inductor for imparting a mixing movement to the cast liquid metal.

A conventional ingot mold for continuous casting of metal may be considered as a continuously cooled mold which is open at its opposite ends and into which the liquid metal is continuously applied at one of the open ends and a partly solidified ingot is likewise continuously extracted from the other open end of the mold.

Such a mold essentially comprises an inner tube, in contact with the liquid metal and determining the cross-section of the ingot to be cast and an outer cooling jacket defining with the inner tube an annular passage for a cooling fluid. The inner tube which is usually formed from copper or copper alloy, assures a good heat transfer between the metal to be cast and the cooling fluid, whereas the cooling jacket is usually made from steel and assures, usually in association with an outer shell, the rigidity and the mechanical resistance of the assembly.

If products of relatively small cross-section, such as billets are to be cast, the mechanical resistance of the inner copper tube, even of small wall thickness, is usually sufficient so that it is not necessary to provide anchoring elements to fix the inner tube to the cooling jacket.

Often such anchoring elements are not provided at all (French Pat. Nos. 2,248,103 and 2,315,344). However, the case is quite different if products of large cross-section, such as blooms or slabs, are to be cast. In such a case the mechanical resistance of the inner copper tube causes a considerable problem since the increase of the width of the walls of the inner tube leads to a reduction of the resistance against bending and to more important heat deformations.

To overcome these shortcomings, which may lead to a discard of the ingot mold after short use, one has already sought to reinforce the inner copper tube by longitudinally extending ribs defining between themselves channels for the cooling fluid (French Pat. Nos. 2,196,866) or to increase their wall thickness up to a value which does not essentially affect the efficiency of the cooling system, and to anchor the inner tube to a casing which itself has a thickness to provide the assembly with the necessary indispensible rigidity. To carry out such construction it is also known to form and tap blind bores in the inner copper tube and to screw into the tapped bores steel pins which traverse openings correspondingly provided in the cooled jacket and provided at their outer ends with nuts abutting against the jacket.

Such ingot molds are, however, not suitable for every kind of application. This is especially the case if the ingot mold is equipped with an electromagnetic inductor to provide a mixing action on the liquid metal passing through the mold and which find an increasing use in the field of the technical endeavor considered. In this kind of ingot mold the tubular inductor surrounds the cooling jacket. In such a construction it is necessary, in order to prevent weakening of the magnetic field during its passing through the cooling jacket and especially the inner copper tube, to place the inductor as closely as possible to the poured metal. For this purpose it is desirable in the first place to reduce as far as possible the thickness of the walls of the cooling jacket and the inner copper tube.

An ingot mold has already been suggested which takes care of the above requirements (French Pat. No. 2,310,821). In this type of ingot mold the cooling jacket is associated with an outer shell, likewise formed from steel, the casing formed by these elements is provided in its interior with support columns formed with axial bores therethrough for the passage of tie rods. These tie rods are screwed at one end thereof into the inner copper tube and at the other end thereof provided with nuts abutting against the outer shell.

Considering the complexity of the mentioned problems, these ingot molds constitute one of the best solutions at present known. Nevertheless, the presence of the columns of the interior of the casing, which contains the inductor, requires a specific construction of the latter and makes the assembly more difficult as far as its construction and the general use of it is concerned (see for instance the French Pat. Nos. 2,324,395 and 2,324,397).

SUMMARY OF THE INVENTION

It is an object of the present invention to propose a solution for the above-mentioned problems which avoids the inconveniences and shortcomings of the known solutions.

With this and other objects in view, which will become apparent as the description proceeds, the cooling jacket for an ingot mold for continuously casting of metal mainly comprises a tube and a grid of stiffening ribs projecting from the outer surface of the tube, in which the grid is provided at the intersection of the stiffening ribs with openings passing also through the tube.

According to one form of the present invention the tube is of quadrangular cross-section, square or rectangular, and each side of the quadrangle is provided with at least three longitudinally extending stiffening ribs, one being at the center of the side and the other two laterally spaced therefrom adjacent to the corners of the quadrangle.

In an advantageous construction of the present invention the cooling jacket is surrounded outside of the stiffening ribs with an outer shell.

It is also an object of the present invention to use the aforementioned cooling jacket in an ingot mold for continuous casting of metal passing through an inner tube which is anchored on the cooling jacket by means of tie rods passing through the openings provided in the grid of stiffening ribs.

According to a characteristic of the ingot mold of the present invention, an electromagnetic inductor is arranged around and in close vicinity to the cooling jacket.

The basic feature of the present invention is, therefore, to provide a cooling jacket with reinforcements in such a manner that the same forms a rigid supporting element for the inner copper tube with which it is rigidly connected. The reinforcements provided on the outer surface of the cooling jacket form a grid of stiffening ribs, the intersections of which constitute the preferred locations for the placement of means to connect the cooling jacket to the inner tube.

It might be noted that, while the present invention is especially useful for solving the problems occurring during the casting of ingots of large cross-section, it is not restricted to such applications, but the present invention may be employed regardless of the dimension and the form of the castings produced. It is, however, mentioned that the preferred field of application of the present invention resides in an ingot mold provided with an electromagnetic inductor since the invention permits to reconcile in a satisfactory manner the apparent contradictory requirements, that is, on the one hand the presence of the inductor in the ingot mold to impart a mixing action to the liquid metal, and on the other hand the durability of the ingot mold itself, insofar as the heat exchange between the cast metal and the cooling liquid is concerned. On the one hand, the invention permits to utilize with full security metallic elements of relatively small thickness, that is analogous to those which are used in ingot molds for casting ingots of small size, and on the other hand it permits by the specific arrangement of the supporting structure to counteract in the best manner the formation of induced current in the reinforcement ribs and in consequence thereof a reduction of the weakening of the magnetic field.

In addition, the invention presents a great flexibility as to its use since it permits, as will be pointed out later on, to adapt the form of the reinforcement ribs to the geometry of the inductor. This presents a special advantage in that, in starting out with a given inductor for the ingot mold, it is possible to cool different ingots by simple replacement of the unit formed by the cooling jacket provided with reinforcements and the inner copper tube connected thereto.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
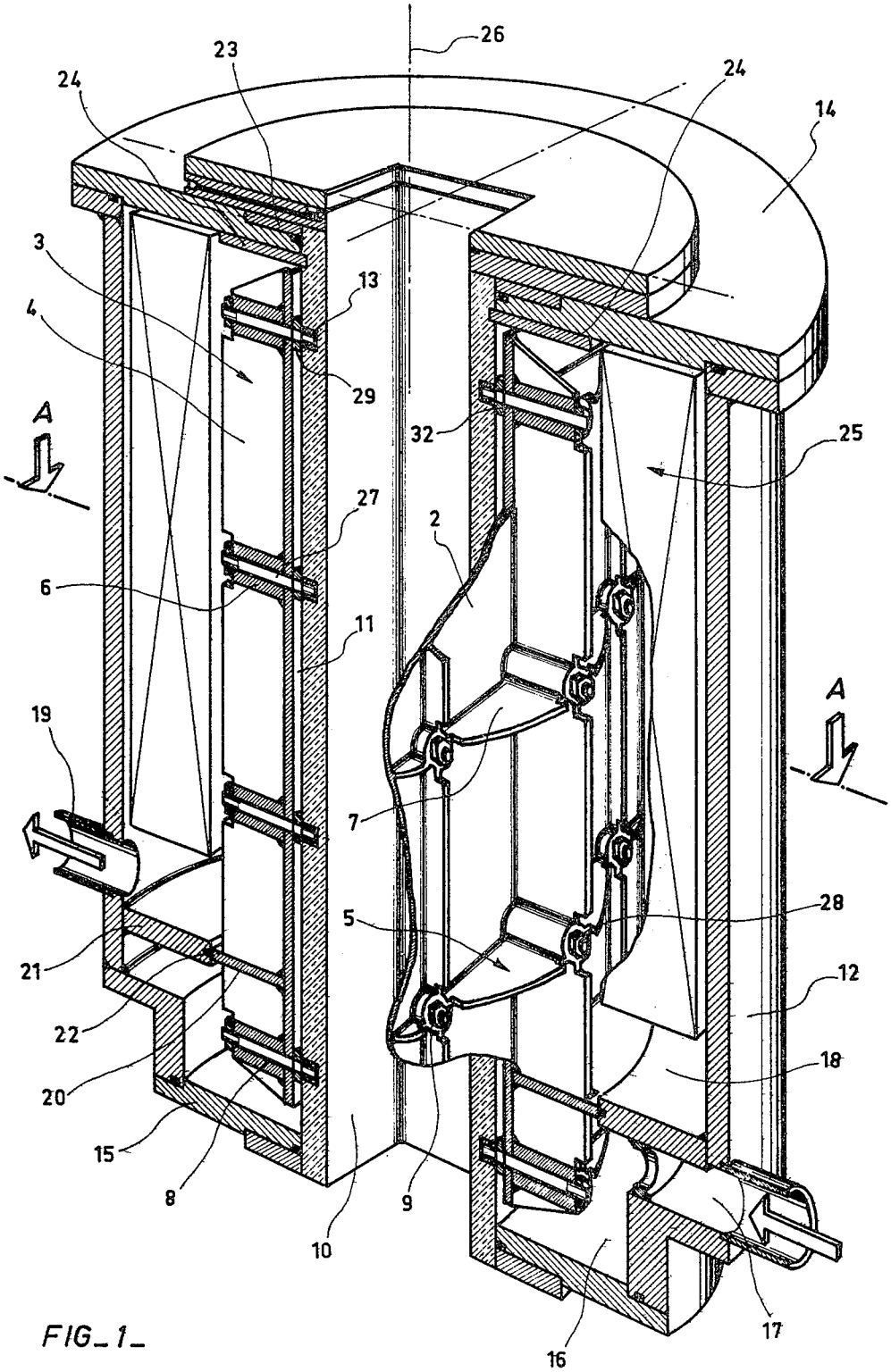
FIG. 1 is a partly sectioned perspective view of an ingot mold for continuous casting of metal provided with an electromagnetic inductor and a cooling jacket according to the present invention.
Figure 2:
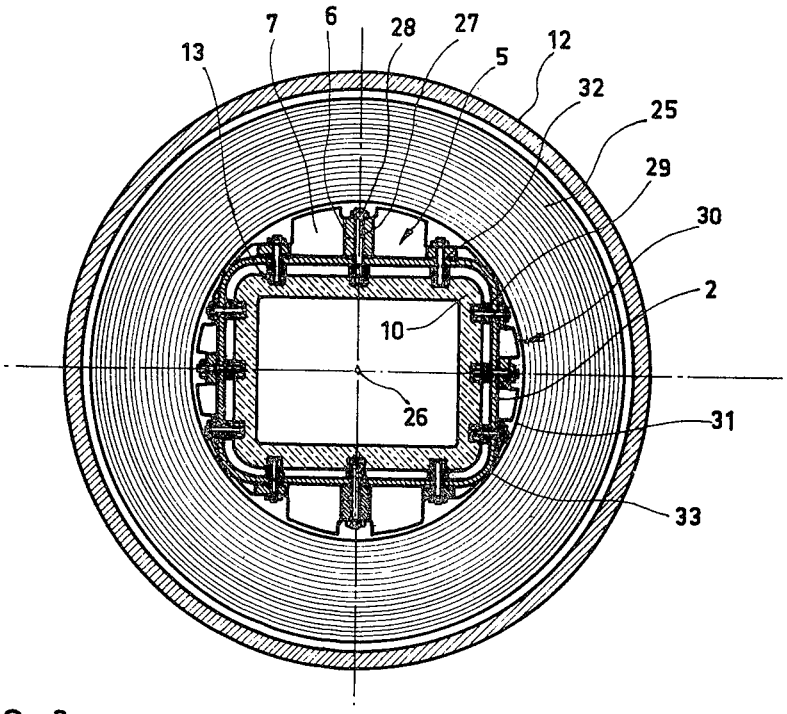
FIG. 2 is a transverse cross-section taken along the line A—A of FIG. 1 and showing an ingot mold for casting products of rectangular cross-section.

Referring now to the drawing, and more specifically to FIGS. 1 and 2, it will be seen that the ingot mold for continuously casting of metals, especially steel, comprises an inner tube 10, formed from copper or copper alloy, and defining a passage for the metal to be cast, and a cooling jacket 2 of steel, according to the present invention, which will be described in further detail later on. The cooling jacket 2 surrounds the inner copper tube 10 in such a manner so as to form between these two elements an annular space 11 of uniform width for the circulation of a cooling liquid, usually water, therethrough. the cooling jacket 2 is surrounded by an outer shell 12 of steel, defining with the cooling jacket 2 an annular space closed at the opposite ends by a cover 14 and a bottom plate 15. This annular space is divided into two superimposed chambers, that is a lower chamber 16 for the introduction of the cooling water through a cooling water inlet 17 and an upper chamber 18 for discharge of the cooling water by a cooling water outlet 19.

The division of the aforementioned space into the lower chamber 16 and the longer upper chamber 18 is accomplished by separating wall means, which includes a transverse annular wall 21 fixed, for instance by welding, at the outer circumference to the outer shell 12 and projecting radially inwardly therefrom and a second annular wall 20 fixed at the inner periphery, for instance by welding, to the tubular element of the cooling jacket 2 and an annular rubber seal 22 between the adjacent edges of the annular walls 20 and 21. The cooling jacket 2 communicates at the lower end thereof with the lower chamber 16 and at the upper end thereof with the upper chamber 18. It will be noted that the cooling water inlet 17 is located to one side and closely adjacent to the separating wall means 20, 21 and the cooling water outlet 19 is also located closely adjacent to the separating wall means on the other side of the latter, so that the cooling water passing through the inlet 17 into the lower chamber 16 passes first downwardly through the latter, then upwardly through the clearance between the inner tube 10 of copper and the tubular element of the cooling jacket 2 and then downwardly through the upper chamber 18, to finally leave the latter through the outlet 19. The stiffening ribs 4 and 5 projecting outwardly from the tubular element of the cooling jacket 2 are thus impinged by the cooling water flowing downwardly in the upper chamber, so that these stiffening ribs form at the same time cooling ribs, thereby increasing the cooling effect provided by the cooling jacket according to the present invention.

The inner tube 10 is held at its upper end by a collar 23 abutting against the cover 14 and the fastening of the inner tube to the cover is further completed in the usual manner by a plurality of wedges 24.

As can be seen from FIG. 1 an electromagnetic inductor 25, only schematically shown in this Figure and of tubular construction as shown in FIG. 2, occupies a major part of the upper chamber 18. The electromagnetic inductor 25 is a polyphase, usually three-phase inductor serving, as known, to provide a mixing action on the liquid metal to be cast by means of a mobile magnetic field. Depending on the construction of the inductor 25, the mixing movement may take place along planes including the axis 26 of the ingot mold (a vertically moving electromagnetic field) or in planes normal to this axis (a turning magnetic field). In the first case, the inductor is constituted by a stack of horizontally arranged coils connected to a polyphase current supply in such a manner to create in the air gap an electromagnetic flux which is propagated along the axis 26 (see especially the French Pat. Nos. 2,248,103 and 2,352,430). In the second case, the mixing action is provided by an inductor comprising a plurality of coils with horizontal axes and inner cores distributed uniformly about the product to be cast. If this inductor is connected to a polyphase electric current supply, it will generate in the interior of the product to be cast a magnetic field oriented perpendicular to the axis 26 and rotating about this axis 26 to entrain during its movement the liquid metal (see especially the French Pat. No. 2,315,344). Both types of inductors and their application in an ingot mold for continuous casting of metal are well known in the art and the specific type of inductor does not form an object of the present invention.

More specifically, the invention is concerned with the provision in the interior of the ingot mold of a cooling jacket 2 provided at the outer face with a grid 3 of stiffening ribs and with means permitting to fasten the inner tube 10 to the cooling jacket 2.

In the illustrated example the grid is composed of stiffening ribs 4 extending in the longitudinal direction and stiffening ribs 5 extending in transverse direction. These stiffening ribs together, whether they extend in the longitudinal or in the transverse direction, have the common function to make up for the mechanical weakness of the internal copper tube 10. The latter is subjected to influences which are the greater the greater the cross-section of the cast product is, that is influences which are of mechanical origin due to the effect of the ferrostatic pressure of the liquid metal to one side of the inner copper tube 10 and to the hydrostatic pressure of the cooling liquid on the other side thereof and to further influences of thermic origin, due to the heat deformation of the inner copper tube, and to great heat gradients existing in its wall.

With regard to the heat deformation, the stiffening ribs produce different effects according to their orientation of the cooling jacket.

The longitudinally extending stiffening ribs 4 act against the longitudinal deformation resulting in an elongation of the inner copper tube 10 by expansion. As is known this elongation due to heat expansion will detrimentally effect the profile of the inner copper tube by bulging, buckling or modification of its conicity.

The transversely extending stiffening ribs 5 counteract the peripheral deformation of the inner copper tube 5, which modify the geometric shape of the cast product. The latter-mentioned deformations are in general more severe than the preceding ones since the expansion along the circumference and the resultingf deformations are more pronounced and they effect directly the cooling system of the ingot mold.

As mentioned before, the places of intersection of the stiffening ribs constitute the preferred location for the placement of anchoring means. It is at these places in which a maximum of material is available, which facilitates forming of bores at these places. For this purpose, it is advantageous, as shown in the drawing, to realize the grid of stiffness by an assembly of columns or bosses 6 and stiffening element 7 connecting these bosses to each other and constituted by metallic plates disposed on edge.

The columns or bosses 6 are provided with axially extending bores therethrough to form internal passages 8 for the extension of fixing elements therethrough. The bosses 6 and the stiffening ribs are connected to the tubular element of the cooling jacket 2 by welding. The bores 8 form guides facilitating to pierce also the tubular element of the cooling jacket.

The andchoring means are constituted by tie rods 27 which pass through the aforementioned bores 8 and the openings 32 in the tubular element of the cooling jacket. The tie rods 27 are provided at opposite end portions with external screw threads and the inner threaded end of each tie rod is screwed into a steel insert 13 connected, in a manner known per se, to the inner copper tube. Nuts 28 are screwed onto the outer threaded ends of the tie rods abutting on planar end faces 9 provided at the outer ends of the bosses.

Spacer elements 29 placed between the inner copper tube 10 and the tubular element of the cooling jacket 2 will assure the presence of an annular passage 11 for the cooling fluid. These spacer elements 29 are preferably in the form of ring washers arranged about the tie rod, as shown in the drawing. According to another feature of the present invention, the stiffening ribs have outer edges 30 (FIGS. 2 and 3) which are located along a cylinder which conforms to the inner surface 31 of the inductor 25. Referring more specifically to FIG. 2, it will be seen that according to another characteristic feature of the present invention applicable to an ingot mold for the casting of quadrangular products, the surface of the imaginary cylinder along which the outer edges of the stiffening ribs are located is constituted by a circular cylinder concentric with the tubular element of the cooling jacket and having a diameter equal to the diagonal thereof. This construction permits to place the inner surface of a tubular inductor 25 closely adjacent to the outer edges of the stiffening ribs.

If desired, the structure may be further reinforced by providing along the surface 30 a rigid annular envelope or reinforcing casing 34 (FIG 4) formed by an assembly of plates 35, preferably of a magnetic steel and of a thickness of a few millimeters, connected by welding to the ribs of the cooling jacket 2 and disposed side-by-side in such a manner to cover the grid of stiffening ribs. Openings are provided in these plates in the region of the bosses in order to provide free access to the nuts. The thus-formed assembly constitutes a casing delimited at opposite sides by the tubular element of the cooling jacket 2 and by the outer envelope 34, and the interior of this casing is divided by the stiffening ribs.

Figure 4:
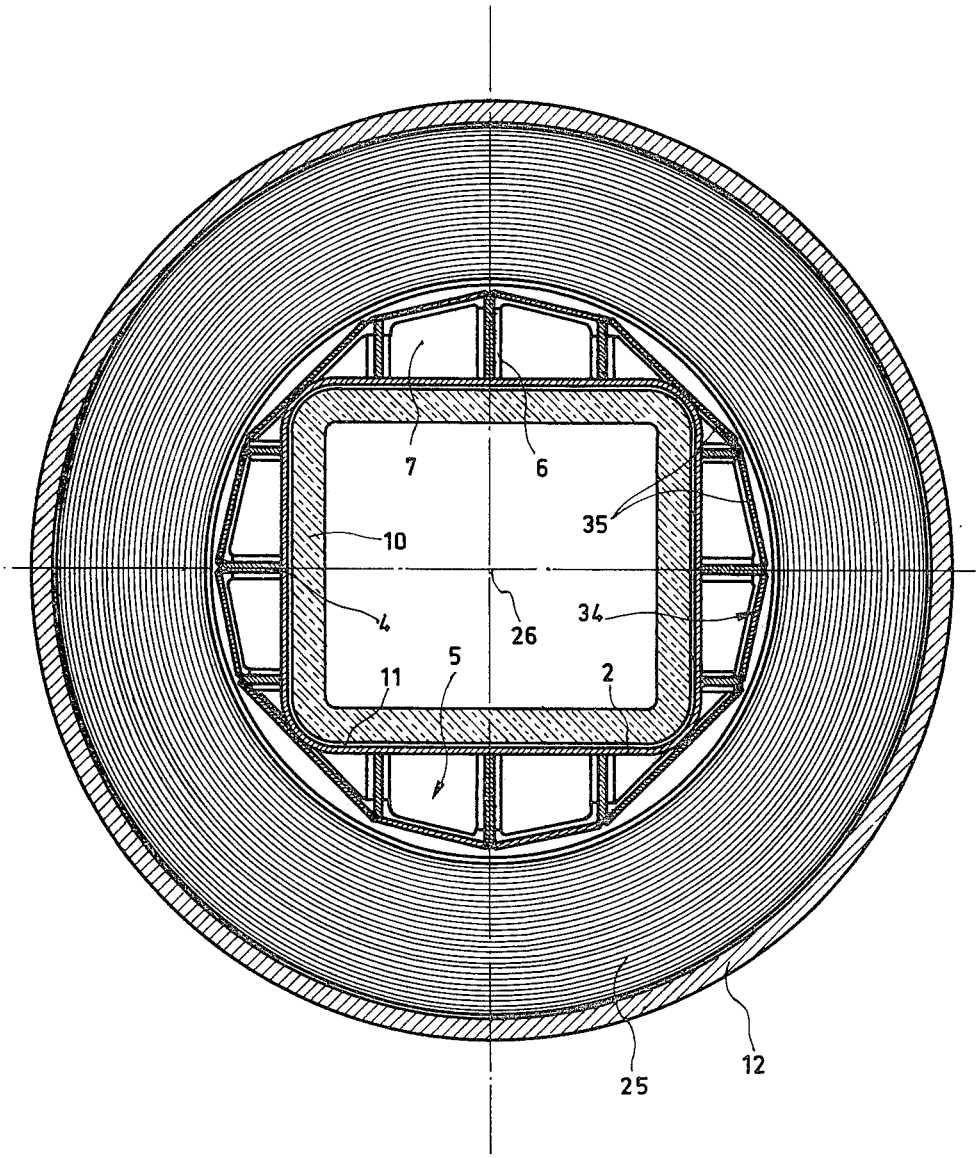
FIG. 4 is a cross-section similar to FIG. 2, in which the cross-section is, however, taken not passing through the intersections of the stiffening ribs and illustrating an advantageous construction according to the present invention.

Tests carried out by the inventors have shown that this modification illustrated in FIG. 4 is especially advantageous to maintain the mechanical rigidity of the asssembly. In addition as far as the action of the electromagnetic inductor is concerned, this modification is actually less troublesome than it seems to be at a first glance. Actually, taken into consideration the low frequency of the supplying current generally used (2–25 Hz) the depth of the penetration of the magnetic induction, calculated by known formulae, is still greatly superior to the thickness of the envelopes 34, so that the latter hardly reduces the magnetic field transversing this envelope.

Studies carried out by the inventors have also shown that the heat deformations of the inner tube 10 along its periphery are fully mastered if one places on each of the planar faces of the cooling jacket at least three anchoring points, one located at the center of the face and the other two adjacent to the corner 33 thereof. For this purpose three longitudinally extending stiffening ribs 4 are provided on each face of the cooling jacket, as shown in FIG. 2.

Figure 3:
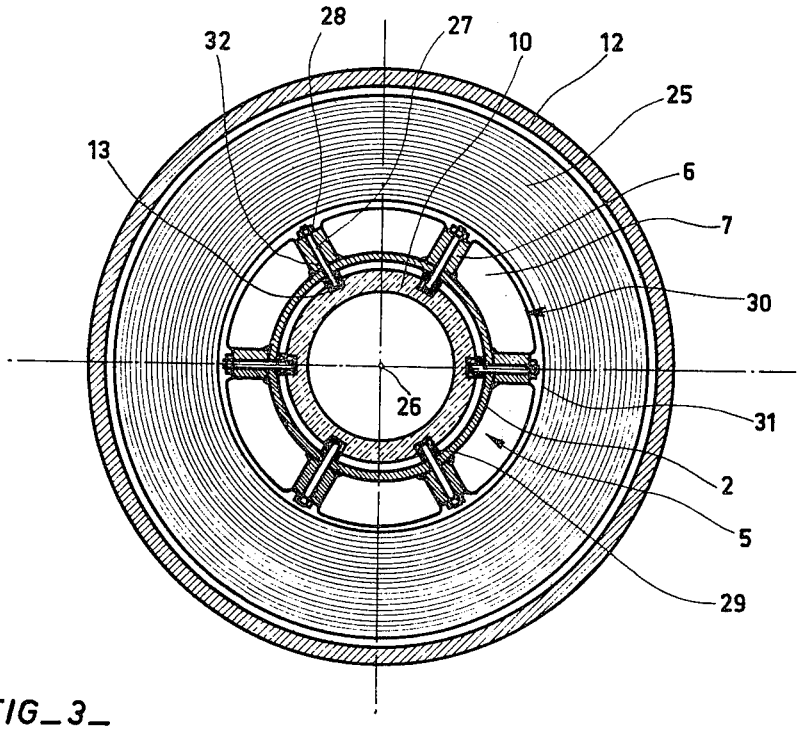
FIG. 3 is a cross-section similar to FIG. 2, but showing an ingot mold for casting of products of round cross-section.

FIG. 3 illustrates an ingot mold for the continuous casting of ingots of circular cross-section in which the longitudinally extending stiffening ribs extend uniformly spaced from each other from the cylindrical tubular element of the cooling jacket 2, whereas the transverse stiffening ribs 5 have outer edges 30 concentric to this tubular element of the cooling jacket.

It will be understood that each of the elements described above, or two or more together, may also find a useful application in other types of cooling jackets for ingot molds differing from the types described above.

While the invention has been illustrated and described as embodied in an ingot mold for the continuous casting of metal provided with the cooling jacket according to the present invention, it is not intended to be limited to the details shown, since various modifications and structural changes may be made without departing in any way from the spirit of the present invention.

Thus, the stiffening ribs forming the grid may have also another orientation with regard to the longitudinal axis of the ingot mold and the stiffening ribs may also extend in diagonal direction. Furthermore, the stiffening ribs may not only be welded to the tubular element of the cooling jacket, but integrally molded therewith in an appropriate mold.

The present invention may be used not only in ingot molds for the continuous casting of billets or blooms, but likewise for the continuous casting of products of very large cross-section, such as slabs. Finally, the invention is not only usable for the continuous casting of steel, but may be also used for the casting of other metals which can be cast in a continuous manner.

Without further analysis, the foregoing will so fully reveal the gist of the present invention that others can by applying current knowledge readily adapt if for various applications without omitting features that, from the standpoint of prior art, fairly constitute essential characteristics of the generic or specific aspects of this invention.

What is claimed as new and desired to be protected by Letters Patent is set forth in the appended claims:

1. In a substantially vertically extending ingot mold for the continuous casting of metal, especially steel, a combination comprising an inner tube having opposite open ends for the passage of the metal to be cast, said tube defining an internal mold surface and having an opposed outer surface; a cooling jacket surrounding said inner tube radially spaced therefrom, said cooling jacket comprising a tubular element uniformly spaced from the outer surface of the inner tube and a grid of stiffening ribs projecting from an outer surface of the tubular element, said grid being provided at intersections of said stiffening ribs with bores extending therethrough and also through said tubular element; fastening means extending through said bores for fastening the inner tube to said cooling jacket, an outer shell surrounding said cooling jacket with considerable clearance coaxially therewith; a cover closing the upper end of the outer shell; a bottom plate closing the lower end of the outer shell, said cover and said bottom plate being formed with openings therethrough aligned with said opposite open ends of said inner tube, said inner tube extending between said cover and said bottom plate and being fastened thereto; and a polyphase inductor surrounding said cooling jacket inside said outer shell.

2. Ingot mold according to claim 1, wherein said tubular element is of quadrangular cross-section and wherein each side of the quadrangle is provided with at least three longitudinally extending stiffening ribs, one being at the center of the side and the other two laterally spaced therefrom adjacent to corners of the quadrangle.

3. Ingot mold according to claim 1, wherein said tubular element is of quadrangular cross-section and wherein outer edges of said stiffening ribs are located along an imaginary cylinder coaxial with the tube and having a diameter equal to a diagonal of the quadrangular cross-section.

4. Ingot mold according to claim 1, wherein said stiffening ribs form at the intersections thereof substantially cylindrical bosses, said openings respectively extending through said bosses coaxially therewith.

5. Ingot mold according to claim 1, wherein said tubular element is of circular cylindrical cross-section and wherein outer edges of the reinforcing ribs are located at an imaginary circular cylinder concentric with said cross-section.

6. Ingot mold according to claim 1, and including an outer metallic reinforcing casing connected to outer edges of said reinforcing ribs, said outer casing being provided with openings respectively aligned with said openings at the intersection of said stiffening ribs.

7. A combination as defined in claim 1, wherein said inner tube is formed from copper and said cooling jacket from steel.

8. A combinatin as defined in claim 7, wherein said fastening means comprise a plurality of tie rods respectively extending through said bores and provided with outer screw threads at opposite ends, and including a steel insert for each of said bores in the inner tube of copper, said insert being provided with an inner screw thread into which an outer screw thread at an inner end of a tie rod is engaged, and a nut screwed onto the outer threaded end of each tie rod.

9. A combination as defined in claim 1, and including separating wall means extending transversely between said tubular element of said cooling jacket and said outer shell and dividing the space therebetween in an upper chamber and a lower chamber, said tubular element of said cooling jacket having opposite open ends respectively communicating with said lower chamber adjacent said bottom plate and with said upper chamber adjacent said cover, cooling water inlet means communicating with said lower chamber adjacent said separating wall means, cooling water outlet means communicating with said upper chamber adjacent said separating wall means, so that the cooling water entering through said inlet means flows first downwardly in said lower chamber, then upwardly through the clearance between said inner tube and the tubular element of said cooling jacket and then downwardly in the upper compartment around the cooling jacket to finally leave through the outlet means, said polyphase inductor being in the upper chamber surrounding the cooling jacket with clearance.

10. A combination as defined in claim 9, wherein said separating wall means comprises an annular wall fixed to and projecting radially inwardly from said outer shell, an additional annular wall fixed to and projecting radially outwardly from said tubular element of said cooling jacket, and a compressable sealing ring between adjacent edges of said annular walls.

11. A combination as defined in claim 9, wherein said lower compartment is considerably shorter than said upper compartment.

12. A combination as defined in claim 11, wherein said grid of stiffening ribs comprises a plurality of ribs extending circumferentially spaced from each other in longitudinal direction of said tubular element of said cooling jacket and a plurality of ribs extending spaced in said direction from each other substantially normal to said direction.

* * * * *